United States Patent [19]

Obradovits

[11] 4,152,790

[45] May 8, 1979

[54] SHOWER ENCLOSURE

[75] Inventor: Nicholas J. Obradovits, St. Louis, Mo.

[73] Assignee: Shower Enclosure Service Company, St. Louis, Mo.

[21] Appl. No.: 874,331

[22] Filed: Feb. 1, 1978

[51] Int. Cl.[2] ..... A47K 3/14

[52] U.S. Cl. ..... 4/149

[58] Field of Search ..... 4/148, 149

[56] References Cited

U.S. PATENT DOCUMENTS

| | | | |
|---|---|---|---|
| 2,747,200 | 5/1956 | Finkel | 4/148 |
| 2,756,438 | 7/1956 | Soberman | 4/149 |
| 2,911,654 | 11/1959 | Bruno | 4/149 |
| 3,591,867 | 7/1971 | Bernstein | 4/148 |
| 4,112,525 | 9/1978 | Roberts | 4/149 X |

*Primary Examiner*—Charles E. Phillips

*Attorney, Agent, or Firm*—Koenig, Senniger, Powers and Leavitt

[57] ABSTRACT

A shower enclosure for confining shower spray to a shower area defined in part by a bathtub or the like and walls at opposite ends of the bathtub. The enclosure is installed between the walls above one side of the bathtub and comprises a rectangular frame and a pair of elongate panels mounted vertically in the frame at opposite sides of the frame. The panels are sufficiently narrow with respect to the width of the frame for providing a relatively large opening between the panels to allow ready access to the shower area. A shower curtain suspended from the frame closes the opening between the panels for preventing escape of shower spray from the shower area through the opening while the panels and frame prevent the escape of shower spray from the shower area at the sides of the curtain toward the ends of the bathtub.

10 Claims, 8 Drawing Figures

SHOWER ENCLOSURE

BACKGROUND OF THE INVENTION

This invention relates to shower enclosures and more particularly to an improved shower enclosure which provides ready access to a shower area such as a shower bath (i.e., a bathtub-shower combination) or shower stall, and which prevents water leakage from the shower area.

Confining shower spray to a shower area, such as a shower bath or shower stall, has been accomplished in various ways, one being by the use of a sliding shower curtain at the open side of the shower area. However, this system has several disadvantages, the most predominant of which is that shower spray tends to escape from the shower stall or shower bath around the side edges of the curtain. The tendency for water to escape is increased by the outward billowing of the curtain during use of the shower which causes the curtain to pull away from the walls and the area for escape of water to be enlarged. This results in wet, slippery floors and oftentimes damage outside the stall or shower bath. Also, shower curtains are particularly unsuited for use in shower stalls since the base of a stall is ordinarily constructed with very low sills which will not readily retain the curtain within the stall.

Swinging or sliding glass doors are also widely used as shower enclosures, but they also present certain problems. For example, such enclosures are expensive and even dangerous inasmuch as they are prone to cracking upon being closed too vigorously. Moreover, the doors themselves inherently limit accessibility to the shower area, a disadvantage particularly undesirable to a physically disabled person or to one trying to bathe a yound child. Mechanical problems with sliding (or hinged) doors can also arise.

SUMMARY OF THE INVENTION

Among the several objects of this invention may be noted the provision of an improved shower enclosure for confining shower spray to a shower stall or shower bath; the provision of such an enclosure which provides increased access to the stall or shower bath; the provision of an improved shower enclosure which is safe to use and relatively maintenance-free; the provision of such an enclosure which may readily be assembled to fit shower stalls or shower baths of various sizes, thus reducing the number of enclosure sizes which need to be stocked; the provision of such an enclosure which is simple in design, economical to manufacture and easy to assemble and clean; and the provision of such an enclosure which is pleasing in appearance for enhancing the attractiveness of the shower area.

Briefly, a shower enclosure of this invention confines shower spray to a shower area defined in part by a bathtub or the like and walls at opposite ends of the bathtub. The shower enclosure is installed between the walls above one side of the bathtub and comprises a pair of long, relatively narrow panels and a rectangular frame. The latter has a bottom frame member adapted to rest atop the bathtub along one side thereof, side frame members adapted to be sealingly secured in water-tight fashion to the walls at the ends of the bathtub, and a top frame member. The bottom, top and side frame members have slots therein extending the entire length thereof for forming a continuous slot around the inside periphery of the frame for holding the panels vertically in the frame at opposite sides thereof with the bottom, one side and top edges of each panel being received in respective slots in the frame members. The panels are sufficiently narrow with respect to the width of the frame for providing a relatively large opening between the panels to allow ready access to the shower area. The panels are held in position in the frame at opposite sides of the frame by a spacer extending between the panels in a slot in either the bottom or top frame member.

The top frame member is adapted to have a shower curtain suspended therefrom for closing the opening between the panels to prevent escape of shower spray from the shower area through the opening. And the enclosure prevents the escape of shower spray from the shower area at the sides of the curtain toward the ends of the bathtub. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
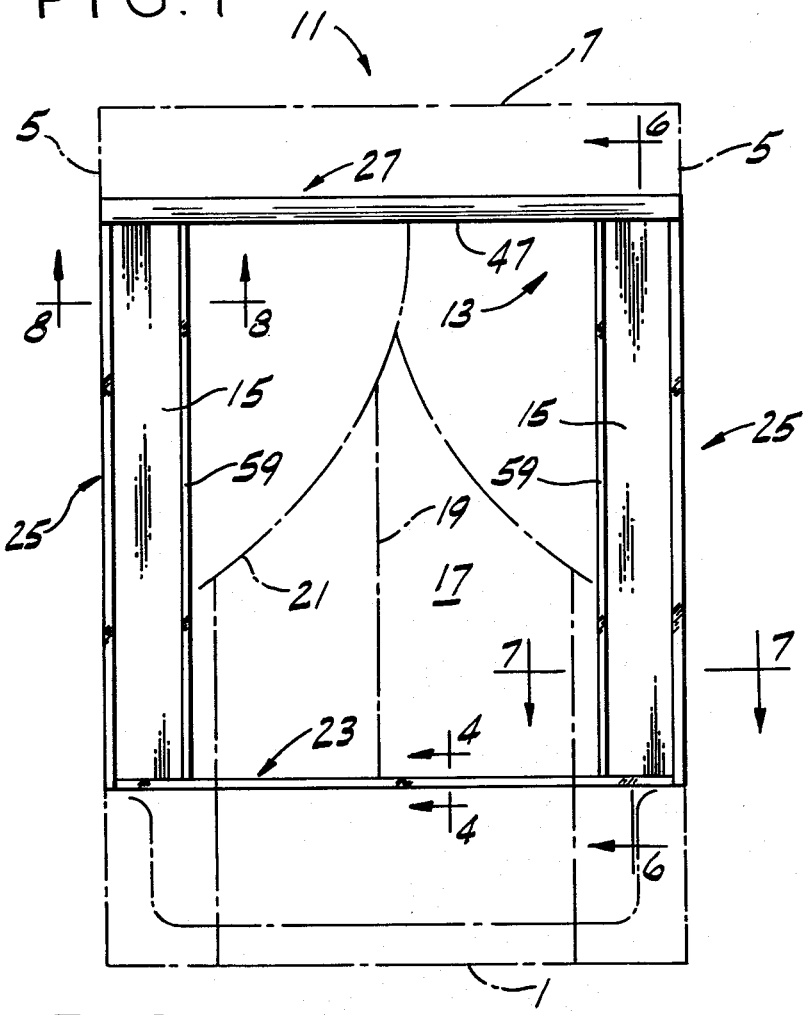
FIG. 1 is a front elevation of a shower enclosure of this invention, showing a rectangular frame mounted atop one side of the bathtub and a pair of elongate panels mounted vertically in the frame at opposite sides thereof.
Figure 2:
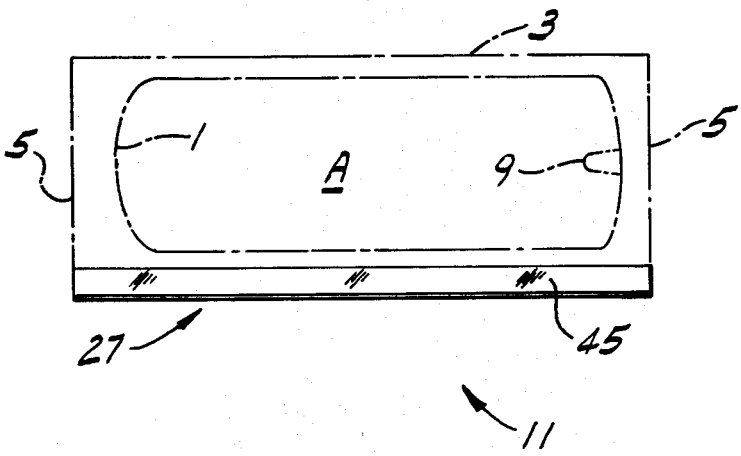
FIG. 2 is a plan of FIG. 1.
Figure 3:
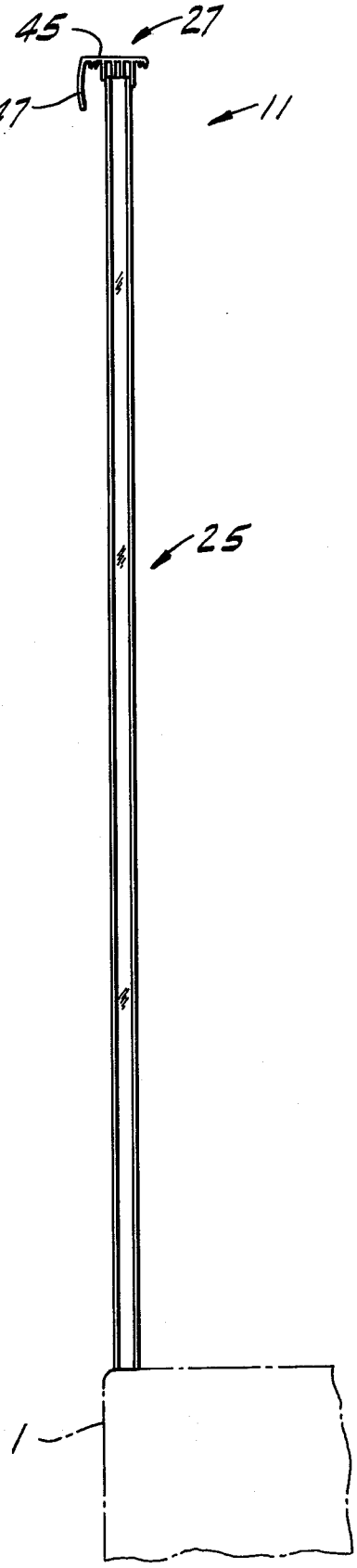
FIG. 3 is an enlarged right-side elevation of FIG. 1, the left-side elevation being a mirror image thereof.

Referring now to the drawings, and particularly to FIGS. 1 and 2, a shower area A is defined in broken lines by a conventional, standard-size bathtub, indicated by reference numeral 1, a wall 3 at the rear of the bathtub, walls 5 at opposite ends of the bathtub, and a ceiling 7. Also shown in broken lines at 9 is a shower head mounted on the right (as viewed in the drawings) end wall 5. A shower enclosure of this invention, designated in its entirety by the reference numeral 11, is installed above the front side of the bathtub and extends between end walls 5 for enclosing the front of the shower area A. Although the closure 11 is shown spaced below the ceiling 7, it will of course be understood that it could extend up to and about the ceiling without departing from the scope of this invention.

The shower enclosure 11 comprises a rectangular frame, indicated generally at 13, and a pair of long, relatively narrow panels or panes, each designated 15, mounted vertically in the frame at opposite sides thereof. These panels 15, which may be of a transparent plastic (such as acrylic or styrene) or any other suitable, shatterproof material, are sufficiently narrow (e.g., 9″) with respect to the width of the frame 13 for providing a relatively large opening 17 between the two panels to allow ready access to the shower area A. The opening 17 is closed by a shower curtain 19 suspended from the frame 13 in a manner to be more fully described hereinafter. A second decorative curtain 21 is also provided.

The frame 13, which may be of aluminum or other suitable lightweight and rustproof material, comprises a bottom frame member 23 atop the front side of the bathtub 1, a pair of side frame members, each generally indicated at 25, sealed to walls 5 at the ends of the bathtub, and a top frame member, generally designated 27. As will appear, these four frame members 23, 25 and 27 have slots S therein extending the entire length thereof which combine to form a continuous slot around the inside periphery of the frame 13 for holding the elongate panels 15 vertically in the frame at opposite sides thereof with the bottom, one side and top edges of each panel being received in respective slots S in the frame members.

Figure 4:
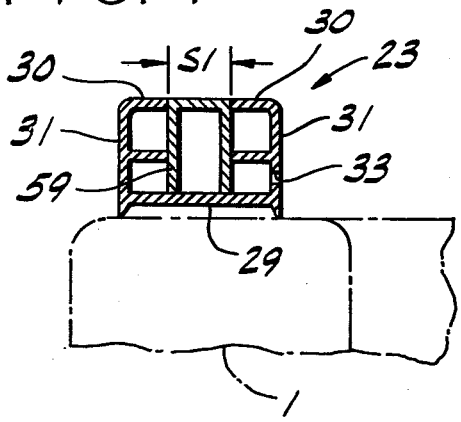
FIG. 4 is a vertical section on line 4——4 of FIG. 1.

More particularly, the bottom frame member 23 is generally of channel shape (see FIG. 4), having a bottom 29 and a pair of side flanges 31, the latter having inwardly turned edges 30 defining a slot S1 therebetween which extends the entire length of the member 23. As shown, the side flanges 31 extend down below the bottom 29 of the member, forming legs for resting atop the front side of the bathtub 1. The bottom 29 of frame member 23 is sloped from left to right (i.e., towards the interior of the bathtub 1) for allowing any water within the member 23 to drain into the bathtub via a drain hole 33 in the right side flange 31. Other drain holes (not shown) are spaced at equal intervals along that flange 31.

Figure 5:
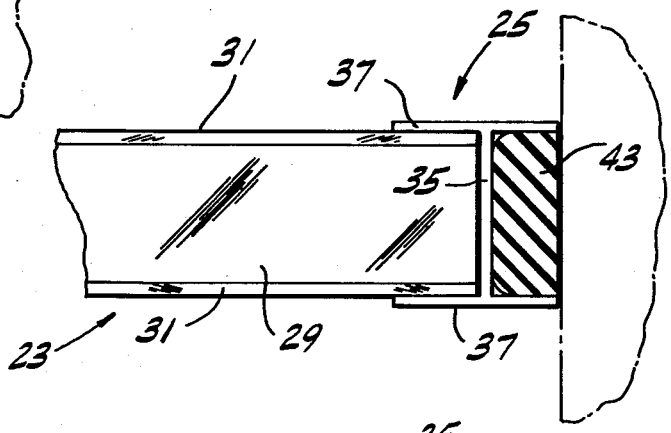
FIG. 5 is an enlarged fragmentary view of the underside of the frame showing the right end thereof.
Figure 7:
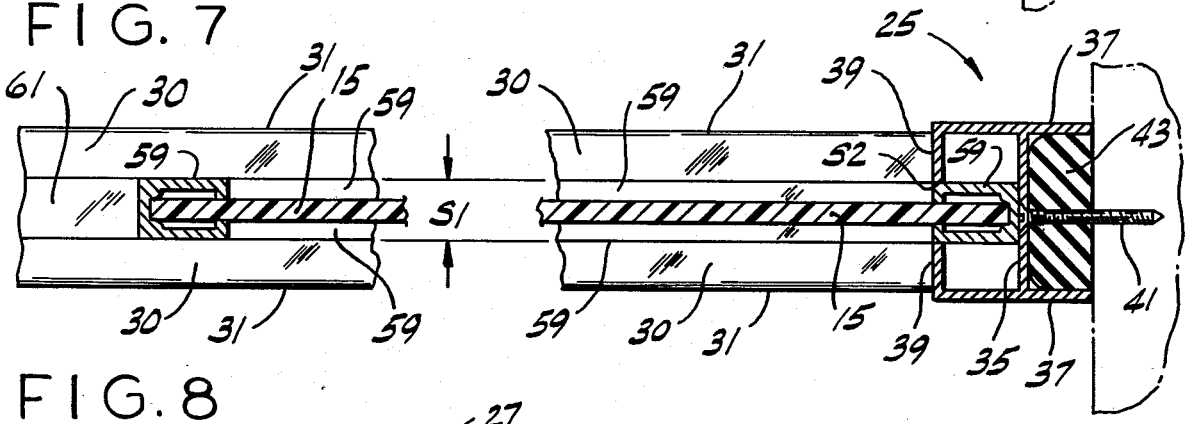
FIG. 7 is an enlarged horizontal section on line 7——7 of FIG. 1.
Figure 6:
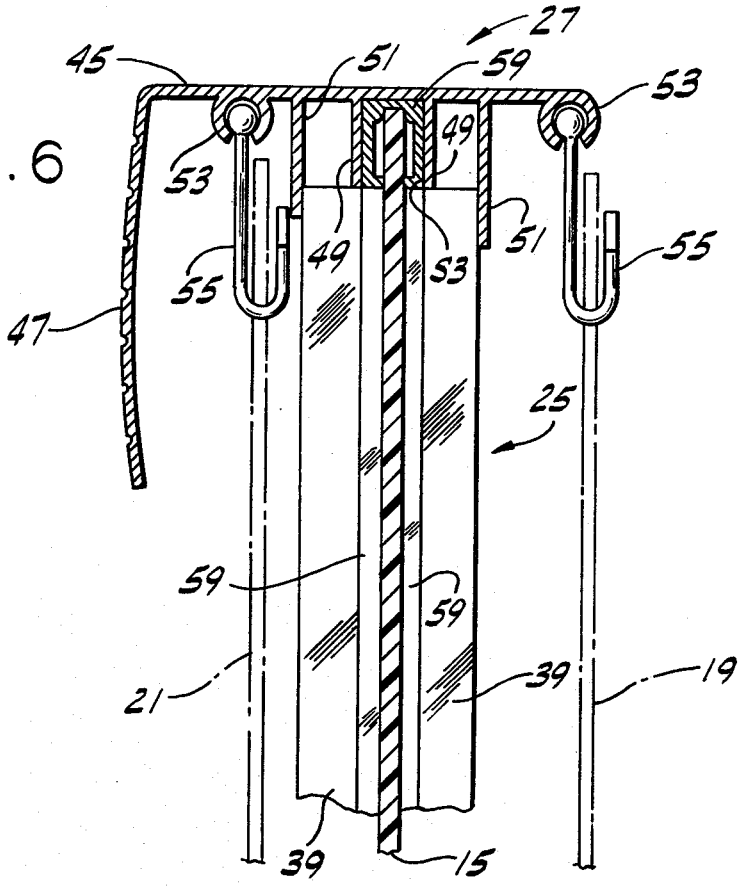
FIG. 6 is an enlarged vertical section on line 6——6 of FIG. 1.
Figure 6:
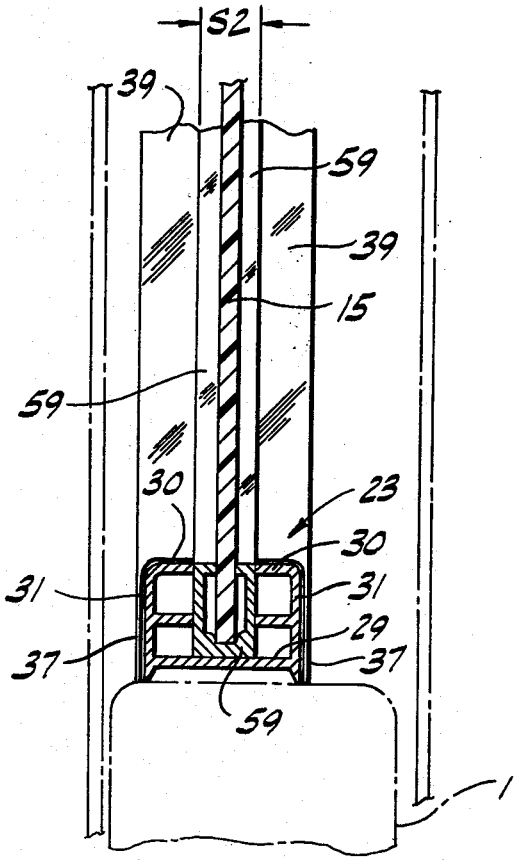

The two side frame members 25 extend upwardly from opposite ends of the bottom frame member 23 and are H-shaped in cross section, each having a web 35 and side flanges 37 at opposite sides of the web (FIG. 7). The edges of the side flanges 37 opposite end walls 5 are turned toward each other, forming lips 39 which define a slot S2 extending the entire length of the side frame member. As best illustrated in FIGS. 5 and 6, these lips 39 are removed toward the lower ends of the two side frame members 25 for reception of opposite ends of the bottom frame member 23 between the side flanges 37, with the side flanges 31 of the bottom frame member 23 interfitting in face-to-face relation with the side flanges 37 of the side frame members. Thus, the bottom frame member is secured in its position atop the bathtub.

Each side frame member 25 is secured to a respective wall 7 by suitable fasteners, such as flathead screws 41, only one of which is shown. Caulking 43 between the web 35 and end wall 5 ensures that the side frame member is sealed to the wall in watertight fashion to prevent the escape of parallel, spray from the shower area A. The side flanges 37 of the side frame members 25 may be shaped as needed to conform to the junctures between the sides of the bathtub 1 and the end walls 5 to prevent leakage of water from the shower area at those points.

The upper end parallel, each side frame member 25 interfits with the top frame member 27 in the manner shown in FIG. 6. That member 27 is generally L-shaped in cross section, comprising horizontal and vertical portions indicated at 45 and 47 respectively. Extending vertically down from the horizontal portion 45 is a brace of shower relatively closely spaced legs 49 which extend lengthwise of the top frame member 27 and define a slot S3 therebetween. Also depending from horizontal portion 45 is a pair of retaining flanges, each indicated at 51. These flanges, which parallel and bracket legs 49, extend down from horizontal portion 45 beyond the lower edges of legs 49 for reception therebetween of the upper ends of the side frame members 25, with the tops of the latter abutting legs 49.

Figure 8:
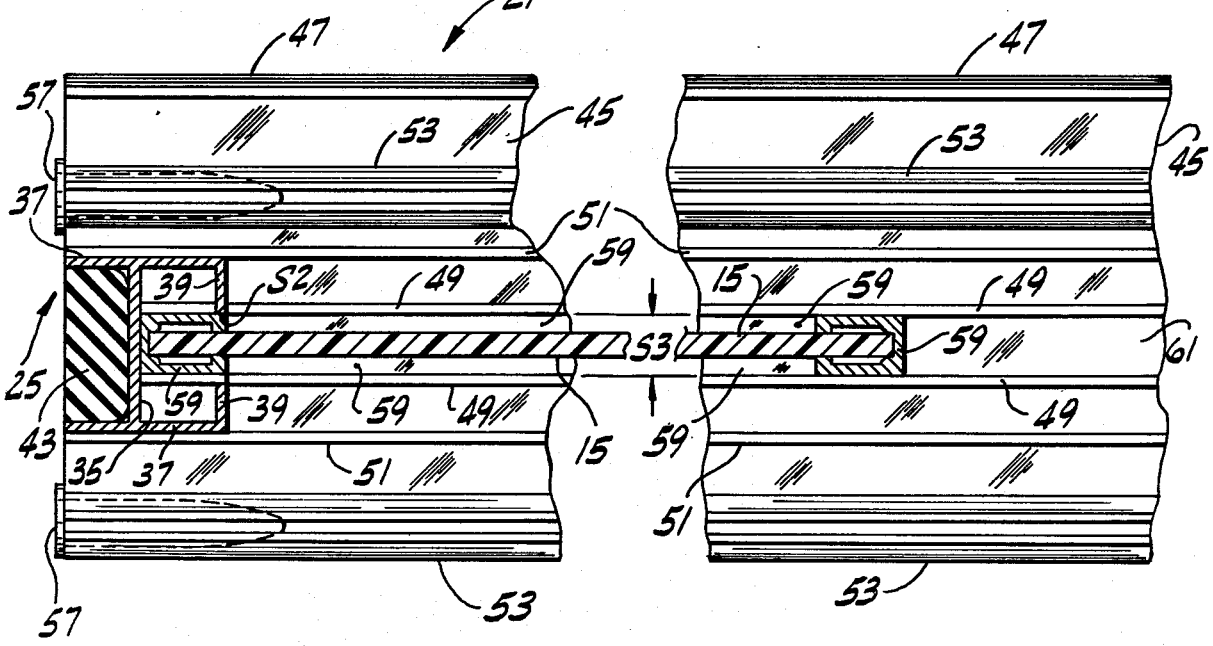
FIG. 8 is an enlarged horizontal section on line 8——8 of FIG. 1.

As viewed in FIG. 6, the inner (right) end of the horizontal portion 45 of the top frame member 27 has a track 53 spaced inwardly (to the right) from the frame for slidably holding a plurality of J-hooks 55 (only one of which is shown) for suspending the shower curtain 19 on the inside of the frame 13 with the curtain hanging down on the inside of the bathtub. The hooks are slidable along the track for sliding the curtain between open and closed positions. Another track, also designated 53, is located on the underside of the horizontal portion 45 of the top frame member to the left of the retaining flanges 51. This track holds hooks for suspending the decorative curtain 21 which hangs down on the outside of the bathtub. Plugs 57 in the ends of the tracks prevent the hooks 55 from sliding out of the tracks (see FIG. 8).

In view of the above, it will be apparent that slots S1, S2 and S3 in the bottom, top and side frame members, respectively, form a continuous slot around the inside periphery of the frame 15 for holding the elongate panels 15 vertically in the frame. In this regard, the bottom, top and side edges of each panel 15 are held in a rectangular subframe 59, three sides of which are in slots S1, S2 and S3, and the fourth of which defines a side of the opening 17. As shown best in FIGS. 6 and 8, this subframe is generally U-shaped in cross section and preferably of the same material as the frame 13 (e.g., aluminum).

For holding the panels 15 in position at opposite sides of the frame 15, the shower enclosure further comprises a pair of elongate spacers, each designated 61, which extend between the panel subframes 59 in slots S1 and S3 in the bottom and top frame members 23, 27. Each of these spacers is of channel shape and lies in an inverted position in a respective slot, i.e., with the open side of the spacer facing away from the opening 17. As illustrated best in FIG. 4, the bottom spacer is dimensioned in cross section for a relatively close fit in slot S1 and the upper side of the spacer is generally flush with the upper surface (i.e., edges 30) of the bottom frame member to provide a continuous flat surface across the top of the bottom frame member. Thus, the spacer 61 in the bottom frame member 23 prevents soap, hair and other debris from falling through the slot S1 and accumulating in the member 23.

From the foregoing, it will be apparent that the shower enclosure 11 effectively confines shower spray to the shower area A. Thus, when drawn to a closed position in which it overlaps both panels 15, the shower curtain 19 prevents shower spray from escaping through the opening 17, while the frame 13 and panels 15 block the escape of shower spray at the sides of the curtain toward the ends of the bathtub 1. At the same time, the relatively large opening 17 between the panels 15 provides ready entrance to and exit from the shower area. Moreover, inasmuch as the panels 15 of the shower enclosure 11 are stationary rather than moving, the chances that the panels will crack or break are reduced considerably. The enclosure is also pleasing in appearance for enhancing the attractiveness of the shower area and simple in design for economical manufacture and easy assembly and cleaning.

The shower enclosure 11 is further advantageous inasmuch as it is adapted for use with bathtubs of various sizes, thus reducing the number of shower enclosure sizes which need to be stocked in inventory. In this regard, the bottom and top frame members 23, 27, which are initially separate from side frame members 25, are cut to fit the particular bathtub and the shower enclosure then assembled for installation. And, although the shower enclosure is illustrated herein installed above a bathtub, it will be understood that it may also suitably be used to close one or two sides of a shower stall, the bottom frame member 23 there resting atop the sill or step-over.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shower enclosure for confining shower spray to a shower area defined in part by a bathtub or the like and walls at opposite ends of the bathtub, said enclosure being adapted to be installed between said end walls above one side of the bathtub and comprising a pair of long, relatively narrow panels, a rectangular frame having a bottom frame member adapted to rest atop the bathtub along said one side thereof, side frame members adapted to be seallingly secured in watertight fashion to said end walls, and a top frame member, said frame members having slots therein extending the entire length thereof for forming a continuous slot around the inside periphery of the frame to hold said panels vertically in the frame at opposite sides thereof with the bottom edge, one side edge and the top edge of each panel being received in respective slots in the frame members, said panels being sufficiently narrow with respect to the width of the frame for providing a relatively large opening between said panels to allow ready access to the shower area, and a spacer adapted to extend between the panels in a slot in one of the bottom and top frame members for holding the panels in position in the frame at opposite sides thereof, said top frame member having a portion extending inwardly from the frame, said portion having a track spaced inwardly from the frame for slidably holding a plurality of hooks or the like for suspending a shower curtain on the inside of the frame with the curtain hanging down inside the bathtub, said hooks or the like being slidable along the track for sliding the shower curtain between a first position in which the opening between the panels is open to permit access to the shower area, and a closed position in which the opening between the panels is closed to prevent escape of shower spray from the shower area through the opening, said enclosure preventing the escape of shower spray from the shower area at the sides of the curtain toward the ends of the bathtub, said top and bottom frame members being initially separate from the side frame members and being adapted to be cut to a length corresponding to that of the bathtub and then assembled with the side frame members, each of the latter comprising a web and flanges at opposite sides of the web adapted to engage a respective end wall with the web spaced from and generally parallel to the wall for reception of caulking or the like between the side flanges to provide a watertight seal between the side frame member and said end wall, and the ends of each of said bottom and top frame members being formed to interfit with the flanges of the side frame members for securing the bottom and top frame members to the side frame members.

2. A shower enclosure as set forth in claim 1 wherein said bottom, one side and top edges of each of said panels are adapted to be held by a subframe in respective slots in said frame members.

3. A shower enclosure as set forth in claim 2 wherein said other side edge of each of said panels is also adapted to be held by said subframe.

4. A shower enclosure as set forth in claim 2 wherein said subframe is generally U-shaped in cross section.

5. A shower enclosure as set forth in claim 2 wherein said frame and said subframe are of aluminum.

6. A shower enclosure as set forth in claim 1 wherein said panels are of substantially transparent material.

7. A shower enclosure as set forth in claim 1 wherein said bottom frame member is generally of channel shape, having a bottom and a pair of side flanges defining a slot therebetween, the channel bottom being sloped from one side flange to the other toward the shower area and the side flange nearest the shower area having a drain hole therein for allowing water to drain from the bottom frame member into the bathtub.

8. A shower enclosure as set forth in claim 1 wherein each side frame member is generally H-shaped in section and said bottom frame member is generally of channel shape, having a bottom and a pair of side flanges, the side flanges of the bottom frame member being adapted to interfit in face-to-face relation with the side flanges of each side frame member on one side of the web of the side frame member, said caulking being adapted to be received between the side flanges of the side frame member on the other side of the web.

9. A shower enclosure as set forth in claim 1 wherein said spacer is elongate and adapted to extend between the panels in the slot in the bottom frame member, and is dimensioned in cross section for a relatively close fit in said slot in the bottom frame member with the upper side of the spacer generally flush with the upper surface of the bottom frame member to provide a continuous flat surface across the top of the bottom frame member.

10. A shower enclosure as set forth in claim 9 wherein said spacer is generally of channel shape.

* * * * *